US005609174A

United States Patent [19]

Ferguson

[11] Patent Number: 5,609,174

[45] Date of Patent: Mar. 11, 1997

[54] SEALED WASH ARM BEARING

[75] Inventor: Mark A. Ferguson, Lavergne, Tenn.

[73] Assignee: Ecolab Inc., St. Paul, Minn.

[21] Appl. No.: 514,676

[22] Filed: Aug. 14, 1995

[51] Int. Cl.[6] ..... A47L 15/22; A47L 15/42

[52] U.S. Cl. ..... 134/180; 239/261; 285/276

[58] Field of Search ..... 134/176, 179, 134/180, 181, 129, 144, 167 R, 168 R; 239/261, 264; 285/276

[56] References Cited

U.S. PATENT DOCUMENTS

| | | | |
|---|---|---|---|
| 1,235,797 | 8/1917 | Haskell | 285/276 |
| 2,983,452 | 5/1961 | Lindbloom | 239/261 X |
| 3,000,036 | 9/1961 | DeBenedetti | 239/264 X |
| 3,064,665 | 11/1962 | Martiniak | 134/176 |
| 3,067,759 | 12/1962 | Guth et al. | 134/176 |
| 3,160,164 | 12/1964 | Constance et al. | 134/176 |
| 3,210,010 | 10/1965 | Delapena | 239/242 |
| 3,384,099 | 5/1968 | Baumann | 134/176 X |
| 3,430,861 | 3/1969 | Geiger et al. | 239/251 |
| 3,468,485 | 9/1969 | Sully | 239/264 X |
| 3,795,924 | 3/1974 | Kempler | 285/276 X |
| 3,910,499 | 10/1975 | Trouilhet | 239/228 |
| 4,014,467 | 3/1977 | Ferguson | 134/179 X |
| 4,174,723 | 11/1979 | Long | 134/144 |
| 4,266,565 | 5/1981 | Gurubatham | 134/144 |
| 4,676,267 | 6/1987 | Bloch | 285/276 X |
| 4,760,857 | 8/1988 | Shiba et al. | 134/144 |
| 4,811,902 | 3/1989 | Nagata | 239/240 |
| 5,165,435 | 11/1992 | Thies et al. | 134/181 |
| 5,259,890 | 11/1993 | Goff | 134/32 |

*Primary Examiner*—Philip R. Coe

*Attorney, Agent, or Firm*—Merchant, Gould, Smith, Edell, Welter & Schmidt, P.A.

[57] ABSTRACT

A wash arm hub for a dishwasher includes a sealed bearing rotatably coupling first and second mounting hub members. The sealed bearing, as well as the first and second hub members, define an interior fluid passageway or chamber to permit fluid to flow through the hub assembly. The sealed bearing and the design of the hub members prevents fluid leakage out of the hub, thereby providing a low friction support for a wash arm and a sealed connection between a fluid supply and the wash arm.

21 Claims, 3 Drawing Sheets

FIG. 1
PRIOR ART
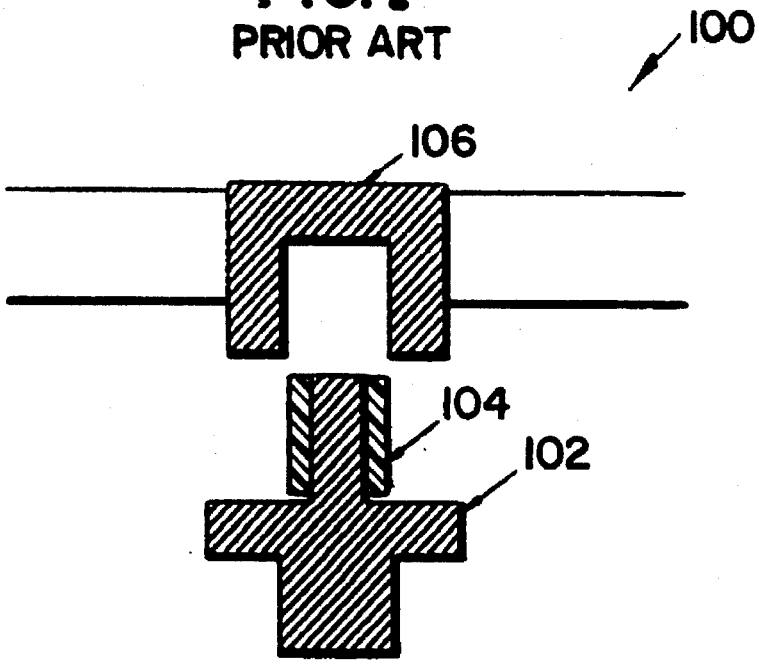
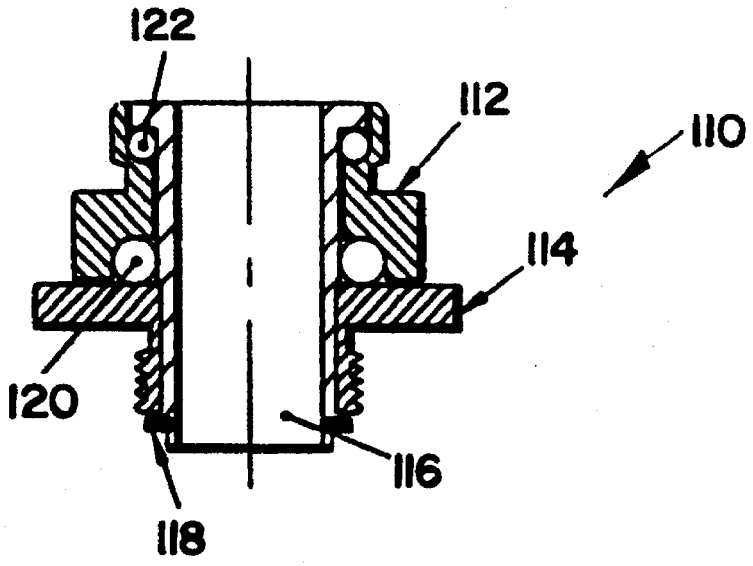
FIG. 2
PRIOR ART

SEALED WASH ARM BEARING

FIELD OF THE INVENTION

The invention generally relates to a wash arm hub assembly for a dishwasher. More particularly the invention is directed to a sealed wash arm hub for reducing fluid loss through the hub.

BACKGROUND OF THE INVENTION

The modern warewasher or dishwasher, to a large extent, provides a time effective way to efficiently and thoroughly wash large volumes of dishes. A typical dishwasher directs sprays of wash solution and/or rinse water (hereinafter generically referred to as "wash fluid") at the surface of dirty dishes or other wares supported on racks or trays in order to remove any dirt and/or food particles from the dirty dishes. Commonly, the wash fluid may include a diluted active agent such as a detergent and/or a sanitizing agent.

Many dishwashers utilize one or more rotatable wash arm assemblies to direct a pressurized spray of wash fluid onto the dishes from multiple directions. The typical wash arm mechanism includes a rotatable wash arm that is internally supplied with a flow of wash fluid. The fluid enters the wash arm at a pressure sufficient to generate a spray out of small holes in the wash arm. The holes are spaced out along the length of the wash arm, and may be oriented in different directions, so as to maximize the area covered by the spray. Furthermore, the holes in the wash arm are oriented to provide a net torque sufficient to spin the wash arm and increase the effective area covered by the spray.

Wash arm mechanisms typically include structure for communicating wash fluid to the wash arm and structure for permitting the wash arm to rotate. Commonly, these two functions are provided by a single wash arm hub, so that wash fluid is supplied to the wash arm through the rotatable coupling for the wash arm.

The prior art discloses numerous mechanisms to support and to supply fluid to the wash arm. For example, U.S. Pat. No. 5,165,435 discloses such a support assembly where a low friction washer supports a wash arm hub. An annular flange is used to rotatably connect the wash arm hub to a fluid supply means, typically using a bolt or knob. The tightness of this bolt or knob typically increases the tightness of the seal between the wash arm hub and the annular flange. Increased tightness, however, also increases the rotatable friction between the wash arm hub and the annular flange. Another example of such an arrangement is U.S. Pat. No. 3,160,164.

These designs trade off the tightness of the seal provided by the wash arm hub and the resulting friction. In other words, the looser the fit between the wash arm assembly and the support structure, the greater the amount of fluid leakage and pressure loss. A tighter fit, however, increases rotational friction between the support structure and the wash arm. This trade off is critical because high fluid pressure and sufficient fluid supply are necessary to spin the rotatable wash arm and efficiently clean dishes. Stubbornly attached particles often require a long exposure to a hot, high pressure spray. Consequently, fluid which leaks from the wash arm hub increases the total amount of fluid required to clean the dishes. Furthermore, stubbornly attached particles may need to be impacted by a spray from numerous directions. Consequently, free rotation of the wash arm improves the overall cleaning qualities of the automatic dishwasher.

Some machines have attempted to overcome the fluid supply pressure limitation by using a powerful motorized pump. As a result, the seal/friction trade off becomes less important because the pump supplies an excess of pressure sufficient to overcome the high friction associated with typical fluid supply and support mechanisms. Such complicated mechanisms typically make the replacement of worn seals difficult. Furthermore, although the increased pressure decreases the importance of the seal/friction trade off, such a design increases the amount of fluids used.

Other standard wash arm designs have primarily sought to use two types of unsealed bearings: sleeve or roller. A sleeve bearing, such as sleeve bearing 100 shown in FIG. 1, simply provides a low friction sleeve 104 between a hub 102 and a wash arm 106. This design allows for easy replacement, however, it also results in significant leakage and comparatively large rotational friction which wears the hub components. Alternately, a roller bearing, such as roller bearing 110 shown in FIG. 2, may provide a low friction support for a wash arm. Roller bearing 110 uses inner and outer races of bearings 120, 122 which are enclosed by a hub nut 112 and hub spindle 116. Inner race 120 is also supported by a hub bushing 114. A ring retainer 118 prevents hub spindle 116 from moving relative to hub bushing 114. This configuration works to reduce lateral rotational friction resulting from the spinning of a wash arm and vertical rotational friction resulting from the support of a wash arm. Roller bearings 120, 122, typically constructed of stainless steel, typically wear well. The main disadvantage of this design, however, is that it allows fluid to flow past the bearing races 120, 122, and therefore may leak a significant amount of fluid.

Still other designs have simply accepted high fluid loss in favor of reduced friction. For example, U.S. Pat. No. 3,064,665 uses ball bearings to support a shaft connected to an upper reaction rotatable wash arm. This device, however, also typically allows significant leakage between the fluid supply means and the support shaft.

In view of the foregoing, a number of problems result from the limitations of the existing designs. For example, automatic dishwashers which use wash arms with conventional hubs end up consuming more wash fluid, including more water and more active agent (e.g., detergent or sanitizing agent). As a certain amount of spray volume is necessary to remove certain attached particles, the fluids leaked through a conventional hub must be supplied by additional total volume to maintain the same degree of washing efficiency.

Also, a conventional hub requires an increased amount of energy to be expended to heat the additional fluids. Both such requirements have obvious economic and environmental disadvantages.

Additionally, the cycle time required to adequately clean dirty dishes typically increases to supply the additional fluids leaked through a conventional hub. This decreases the overall volume of dishes that may be washed by the dishwasher in a given period of time.

Therefore, a need exists for a wash arm hub which provides low friction and therefore allows easy rotation, while having reduced leakage through the hub, thereby exhibiting decreased fluid and energy consumption, as well as decreased cycle time.

SUMMARY OF THE INVENTION

The invention addresses these and other problems associated with the prior art in providing an efficient and effective wash arm hub utilizing a sealed bearing. The sealed bearing significantly reduces fluid consumption, decreases pressure drop through the wash arm hub, and reduces rotational friction. In some automatic dishwashers, multiple wash arms are used. In such machines, a sealed bearing may be used on each wash arm to further improve dishwasher performance.

Through the use of a sealed bearing in a wash arm hub or support mechanism, the dishwasher cycle time may be decreased, resulting in faster turnaround time for dirty dishes. The reduction in leakage not only decreases overall water use but also decreases energy consumption as not as much fluid need be heated. Also, the reduction in rotational friction allows the wash arm to spin more freely, thus improving the wash arm's ability to rapidly spray dirty dishes from all directions.

Therefore, in accordance with one aspect of the invention, a wash arm hub is provided for use in a dishwasher to rotatably connect a wash arm to a fluid supply. The wash arm hub includes first and second hub members defining an internal channel for communicating fluid between the fluid supply and the wash arm; and a sealed bearing coupled between the first and second hub members for sealing the internal channel and permitting relative rotation between the first and second hub members.

In accordance with another aspect of the invention, a dishwasher is provided which includes a wash tank; a fluid supply means for supplying a wash fluid to the wash tank; a wash arm in fluid communication with the fluid supply means; and a wash arm hub. The wash arm hub includes first and second hub members, respectively mounted to the wash arm and the fluid supply means and defining an internal channel for communicating wash fluid between the fluid supply means and the wash arm; and a sealed bearing coupled between the first and second hub members for sealing the channel and permitting relative rotation between the first and second hub members.

These and other advantages and features which characterize the invention are set forth in the claims annexed hereto and forming a further part hereof. However, for a better understanding of the invention, and the advantages and objectives attained by its use, reference should be made to the drawing, and to the accompanying descriptive matter, in which there is described preferred embodiments of the invention.

BRIEF DESCRIPTION OF THE DRAWINGS

FIG. 1 is an exploded cross-sectional view of a conventional sleeve bearing for use in a wash arm hub.

FIG. 2 is a cross-sectional view of a conventional roller bearing for use in a wash arm hub.

DETAILED DESCRIPTION OF THE PREFERRED EMBODIMENT

Figure 3:
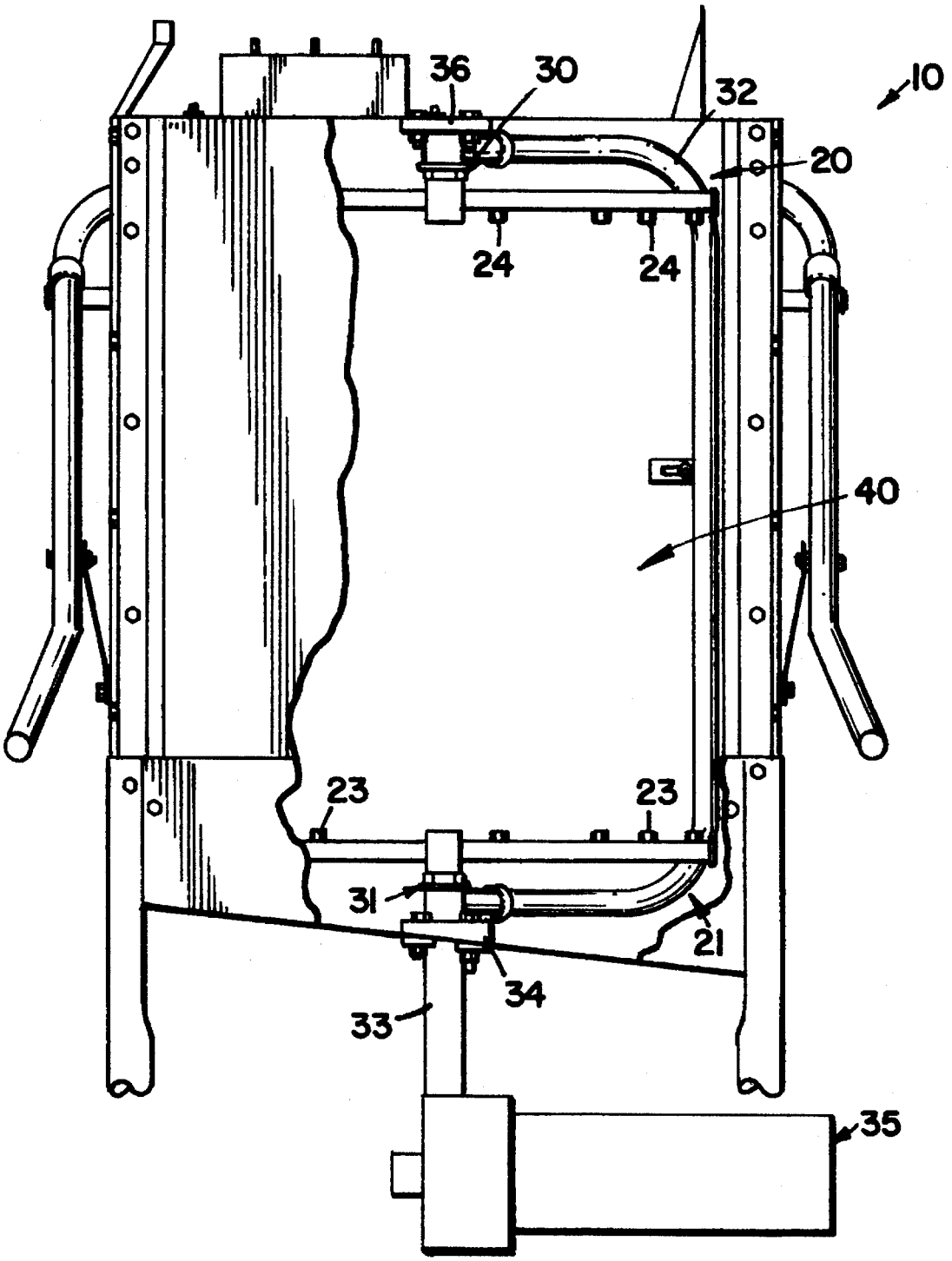
FIG. 3 is a side elevational view of a dishwasher including a preferred wash arm hub consistent with the present invention, with portions thereof cut away.

Turning to the Drawing, wherein like numbers denote like parts throughout the several views, FIG. 3 shows a typical automatic dishwasher 10 which employs both upper and lower wash arms 20, 21. Consistent with the principles of the invention, wash arms 20, 21 are respectively supported by sealed wash arm hubs 30, 31. Hubs 30, 31 provide little rotational friction and allow wash arms 20, 21 to spin freely. Hubs 30, 31 also provide a fluid connection between fluid supply lines 32, 33 and wash arms 20, 21, respectively.

Dishwasher 10 as shown is preferably a Model ES-2000 dishwasher available from Ecolab, Inc. The construction and function of this dishwasher is generally known in the art, and will not be discussed in great detail herein. Moreover, it will be appreciated that this dishwasher is shown for illustrative purposes only, as the principles of the invention may be applied to enumerable types and designs of dishwashers.

Generally, dishwasher 10 includes a fluid supply means with a wash pump 35 coupled to fluid supply lines 32, 33 through a drain valve (not shown) which is movable between two positions to permit pump 35 to (1) recirculate wash fluid from wash tank 40 to the wash arms or (2) drain wash fluid from wash tank 40. A water inlet valve (not shown) is coupled to a water supply to provide water to wash tank 40, and a detergent and/or sanitizing agent supply (not shown) is also coupled to the water inlet valve to introduce an active agent such as detergent or sanitizing agent into the fluid supplied to the wash tank.

In operation, wash pump 35 supplies pressurized wash fluid through a fluid supply tube 33 to a wash manifold 34. Wash manifold 34 diverts a portion of the pressurized fluid to wash arm 21, with the remainder of the pressurized fluid supplied to manifold 36 of upper wash arm 20 through fluid supply tube 32. Wash manifolds 34, 36 therefore provide the mounting and support structure for hubs 30, 31. Also, in connecting the wash manifolds to wash arms 20, 21, hubs 30, 31 allow the pressurized wash fluid to pass from the wash manifolds to the wash arms without restriction, while the wash arms are permitted to freely rotate.

After reaching wash arms 20, 21, the pressurized wash fluid passes through nozzles 23, 24 in wash arms 20, 21, creating a high pressure spray. The nozzles 23, 24 are oriented such that the fluid passing through the nozzles induces a net torque on the wash arms to rotate the wash arms about hubs 30, 31. This rotation, in turn, allows the pressurized spray to cover substantially the entire volume within tank 40 between wash arms 20, 21.

Figure 4:
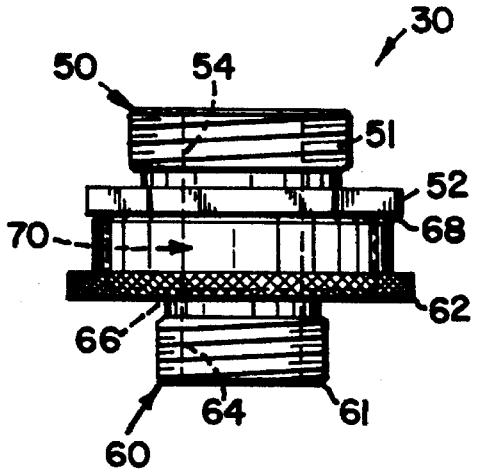
FIG. 4 is a side elevational view of the wash arm hub of FIG. 3.
Figure 5:
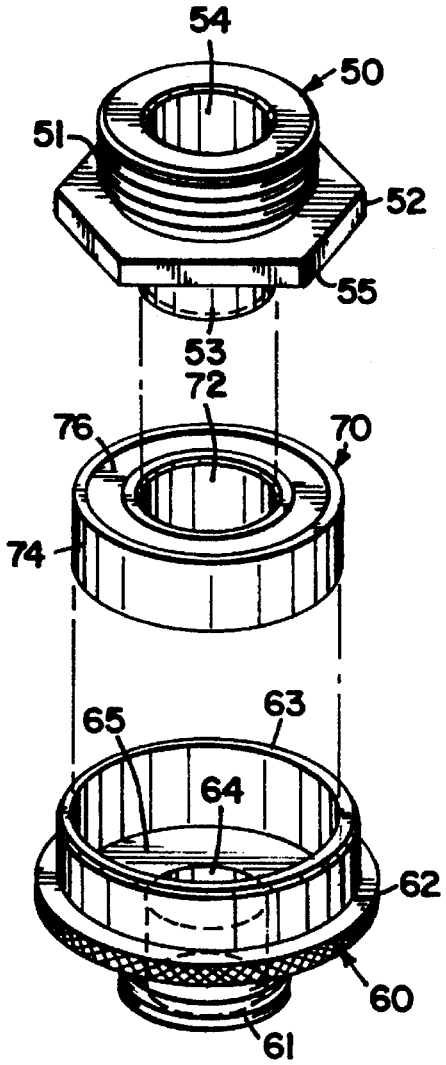
FIG. 5 is an exploded perspective view of the wash arm hub of FIG. 3, with a portion of the sealed bearing used therein cut away for illustration.

Wash arm hub 30 is shown in more detail in FIGS. 4 and 5. Hub 31 is preferably identical in function and form to hub 30.

As best shown in FIG. 5, hub 30 includes a first hub member 50 and a second hub member 60. Member 50 includes a first annular threaded fitting 51 and an enlarged hex head turning shoulder 52 for facilitating the installation of the hub member onto a corresponding threaded fitting on wash arm 20. A first annular flange 53 extends from shoulder 52, and an internal cylindrical wall 54 projects through fitting 51 and flange 53 of member 50 to define portions of the internal conduit or channel through the hub. A first lateral surface 55 is defined on the underside of shoulder 52.

Second hub member 60 also includes a second annular threaded fitting 61 and a turning shoulder 62 having a knurled outer periphery for facilitating the installation of the hub member onto a corresponding threaded fitting on manifold 36. A second annular flange 63 extends from shoulder 62, and an internal cylindrical wall 64 extends through fitting 61 to define a portion of the internal conduit or channel through the hub. A second lateral surface 65 is defined on the underside of shoulder 62, generally opposing the corresponding lateral surface 55 on first hub member 50.

Hub members 50, 60 are preferably machined from 304 stainless steel or another suitable material such as a plastic, another metal, or a composite material. Moreover, fittings 51 and 61 are preferably sized and shaped similar to conventional wash arm hubs used on a number of commercially available dishwashers, such that hub 30 may be directly retrofitted into many commercially available dishwashers with little or no modification. For example, with fittings sized identical to those on the conventional No. 5700-021-35-97 hub available from Jackson Machine Sales Co., Inc., among others, the preferred hub could be used as a direct replacement in a number of dishwashers, including the Hobart ET20 and ET 40 dishwashers, the Stero ETS Glasswasher, the CMA AH2, C2, B2 and A2 dishwashers, and the ADS FG and AG dishwashers. It will be appreciated, however, that the particular design of the hub members may vary depending upon such considerations as the particular structure on the wash arm and/or the fluid supply means to which the hub members are connected, as well as the particular design of the sealed bearing housed between the hub members.

Hub members 50,60 are rotatably coupled through a sealed bearing 70. Bearing 70 is preferably an annular bearing which generally includes inner and outer races 72, 74 rotatably coupled through a plurality of ball bearings (not shown) and sealed by seals 76 on top and bottom. Bearing 70 preferably provides relative rotation between races 72, 74 with fluid flow through the bearing prevented by seals 76.

Hub members 50, 60 are preferably press fit onto bearing 70 to form hub 30, although other known manners of coupling the members, e.g. using set screws or other connecting hardware, may also be used. To this extent, flange 53 of member 50 preferably has an outer diameter which is slightly larger than the inner diameter of inner race 72 such that flange 53 may be press fit into the central aperture in the bearing. Similarly, flange 63 on member 60 preferably has an inner diameter which is slightly smaller than the outer diameter of outer race 74 such that the bearing is press fit and housed within member 60. Accordingly, when the members are press fit together with bearing 70 housed therebetween, a secure coupling is provided, with minimal external access available to bearing 70 through the hub members. In addition, should the bearing ever wear out, the bearing may be removed from the hub members and a replacement bearing may be press fit into the old hub members, thereby making the hub members reusable. This is in contrast to conventional wash arm hubs where a worn bearing arrangement typically requires the entire hub to be replaced.

An internal passageway or channel through the assembled hub is defined by walls 54 and 64 (which are preferably of similar diameters to reduce any adverse flow effects). In addition, first annular flange 53 on member 50 preferably extends proximate second lateral surface 65 on member 60, but does not contact this surface in operation. Similarly, second annular flange 63 on member 60 preferably extends proximate first lateral surface 55 on member 50, but does not contact this surface in operation. The spaces between flange 53 and surface 65 (designated by reference number 66) and between flange 63 and surface 55 (designated by reference number 68) are preferably minimized to restrict any leakage flow between the bearing and both the internal channel and the external surfaces of the hub. However, by maintaining at least some separation between flange 53 and surface 65, and between flange 63 and surface 55, friction between the members is mostly limited to the friction inherent in bearing 70.

The preferred sealed bearing is the KSK SS60032RS sealed roller bearing which is commercially available from KSK. Typically, this bearing is used in high speed industrial applications. Consequently, in the relatively low speed environment of a dishwasher (about 45 RPM), this bearing should be substantially reliable over time.

Bearing 70 generally includes a plurality of stainless steel roller bearings housed between inner and outer races 72, 74. Both the inner and outer races 72, 74 of this bearing are made of 440C stainless steel. The roller bearings are then sealed between the inner and outer races with top and bottom seals 76 formed of EDPM rubber. A food grade grease such as Coltex Poly FM2 lubricates the bearing. The seals 76 prevent any wash fluid from penetrating the bearing and further prevent any grease from escaping. Food grade grease, however, is used so that if any leaking should occur the dishes should not be contaminated.

Any number of sealed bearing designs may also be used as an alternative to the KSK sealed bearing, e.g., those using different ball bearings, roller bearings, or other types of rolling elements known in the art. Such alternate designs should provide relative movement with reduced friction while providing reduced leakage through the bearings. Examples include several commercially available sealed bearings available from Intercontinental Bearing and Micro Miniature Bearing, among others, and manufactured by KSK, IKS, or SKS, among others.

Any number of hub member designs may also be used as an alternative to the designs disclosed herein. It will be appreciated that the design of the hub members is typically dictated by the surrounding structure on the wash arm and on the manifold or other fluid supply components to which the hub members are attached. However, it is preferable for the hub members to be designed in conjunction with the sealed bearing to minimize any leakage flow out of the internally defined channel in the hub. In the case of the hub members, this is typically accomplished by minimizing any gaps or spaces between the hub members to thereby minimize the exposure of the sealed bearing to fluid.

Various modifications may be made to the preferred embodiments without departing from the spirit and scope of the invention. For example, alternate manifold and wash arm configurations may require different hub attachment structures in lieu of threaded fittings 51, 61. Similarly, the turning shoulders may also vary to include other mechanisms to help secure the hub to a wash arm and/or a manifold. Similarly, alternate sizing, both exterior and interior, may also be used.

Nor should the instant invention be limited to the particular in line configuration herein disclosed. For example, the hub members may be integrally formed in the wash arm and/or the manifold or other structure in the fluid supply means, whereby the sealed bearing may be fit directly into the wash arm and/or the manifold or other portion of the fluid supply means.

Other modifications to the preferred embodiments may be made consistent with the invention. Thus, it will be appreciated that the invention lies in the claims hereinafter appended.

WORKING EXAMPLE

The above discussed preferred embodiment has been found to result in significant improvements in dishwasher performance. Specifically, an Ecolab ES-2000 dishwasher using conventional hubs with standard roller bearings was compared to the same dishwasher using the preferred wash arm hubs. The two dishwashers cleaned butter milk glasses prepared in accordance with National Sanitation Foundation requirements under the following conditions: water temperature of 140° F., incoming water pressure of 20 psi, and 15 drops titration of detergent. The comparative results are shown in Table I:

TABLE I

| | Conventional Hub | Preferred Hub |
|---|---|---|
| Recycled wash cycle: | 72 sec | 60 sec |
| Bottom wash arm pressure: | 14 psi | 15 pis |
| Top wash arm pressure: | 12 psi | 15 psi |
| Water consumption: | 1.7 gallon | 1.2 gallon |

Similarly, an ES-4000 dishwasher, which utilizes two pairs of wash arm assemblies, was also tested. In this test, water consumption decreased by about 1.0 gallon (about 0.5 gallons per pair of wash arms), in particular from about 4.0 to about 3.0 gallons of usage.

Life cycle testing was also performed by running the bearings continuously using clean water with no added detergent. The conventional roller bearings were found to bind up after only 6 hours of continuous use in conventional dishwashers. It is believed that in general the metal balls in the standard bearings may wear out prematurely due to increased friction during low water and/or low detergent situations since these bearing typically rely on the wash fluid for lubrication.

Conversely, testing of the preferred sealed wash arm hubs was stopped after 80 hours of use without any observable degradation in performance, which is believed to be due to the use of a grease lubricant and the reduced leakage through the sealed bearings used therein.

We claim:

1. A wash arm hub for use in a dishwasher to rotatably connect a wash arm to a fluid supply, the wash arm hub comprising:

(a) first and second hub members defining an internal channel for communicating fluid between the fluid supply and the wash arm, wherein the first and second hub members each include a threaded fitting for respectively securing the first and second hub members to the wash arm and the fluid supply on the dishwasher; and (b) a sealed bearing coupled between the first and second hub members for sealing the internal channel and permitting relative rotation between the first and second hub members.

2. The wash arm hub of claim 1, wherein the first and second hub members each include a turning shoulder for facilitating the installation of the first and second hub members onto the wash arm and the fluid supply.

3. The wash arm hub of claim 2, wherein the turning shoulder on the first hub member includes a hex head, and wherein the turning shoulder on the second hub member includes a knurled outer periphery.

4. The wash arm hub of claim 2, wherein the sealed bearing is annular, and wherein the internal channel extends through a central aperture in the sealed bearing.

5. The wash arm hub of claim 4, wherein the threaded fittings on the first and second hub members are annular and define portions of the internal channel, wherein the first hub member also includes a first annular flange extending through the central aperture of the sealed bearing and defining another portion of the internal channel, and wherein the second hub member includes a second annular flange housing the sealed bearing.

6. The wash arm hub of claim 5, wherein the sealed bearing includes inner and outer races, wherein the second annular flange on the second hub member has an inner diameter which is slightly smaller than an outer diameter of the outer race of the sealed bearing such that the outer race of the sealed bearing is press fit within the second flange, and wherein the first annular flange on the first hub member has an outer diameter which is slightly larger than an inner diameter of the inner race of the sealed bearing such that the first flange is press fit within the inner race of the sealed bearing.

7. The wash arm hub of claim 6, wherein the first and second hub members respectively include opposing first and second lateral surfaces, wherein the first annular flange extends proximate to but does not contact the second lateral surface, and wherein the second annular flange extends proximate to but does not contact the first lateral surface; whereby spacing between the first and second hub members is minimized to restrict fluid flow to the sealed bearing.

8. The wash arm hub of claim 7, wherein the sealed bearing includes a plurality of roller bearings sealed between the inner and outer races by top and bottom seals disposed between the inner and outer races to prevent flow through the bearing.

9. The wash arm hub of claim 8, wherein the sealed bearing is lubricated by a food grade grease.

10. A dishwasher, comprising:

(a) a wash tank;

(b) a fluid supply means for supplying a wash fluid to the wash tank;

(c) a wash arm in fluid communication with the fluid supply means; and (d) a wash arm hub including:

(1) first and second hub members, respectively mounted to the wash arm and the fluid supply means and defining an internal channel for communicating wash fluid between the fluid supply means and the wash arm; and (b) a sealed bearing coupled between the first and second hub members for sealing the channel and permitting relative rotation between the first and second hub members.

11. The dishwasher of claim 10, wherein the first and second hub members each include a threaded fitting for respectively securing the first and second hub members to the wash arm and the fluid supply means.

12. The dishwasher of claim 11, wherein the first and second hub members each include a turning shoulder for facilitating the installation of the first and second hub members onto the wash arm and the fluid supply.

13. The dishwasher of claim 12, wherein the turning shoulder on the first hub member includes a hex head, and wherein the turning shoulder on the second hub member includes a knurled outer periphery.

14. The dishwasher of claim 12, wherein the sealed bearing is annular, and wherein the internal channel extends through a central aperture in the sealed bearing.

15. The dishwasher of claim 14, wherein the threaded fittings on the first and second hub members are annular and define portions of the internal channel, wherein the first hub member also includes a first annular flange extending through the central aperture of the sealed bearing and defining another portion of the internal channel, and wherein the second hub member includes a second annular flange housing the sealed bearing.

16. The dishwasher of claim 15, wherein the sealed bearing includes inner and outer races, wherein the second annular flange on the second hub member has an inner diameter which is slightly smaller than an outer diameter of the outer race of the sealed bearing such that the outer race of the sealed bearing is press fit within the second flange, and wherein the first annular flange on the first hub member has an outer diameter which is slightly larger than an inner diameter of the inner race of the sealed bearing such that the first flange is press fit within the inner race of the sealed bearing.

17. The dishwasher of claim 16, wherein the first and second hub members respectively include opposing first and second lateral surfaces, wherein the first annular flange extends proximate to but does not contact the second lateral surface, and wherein the second annular flange extends proximate to but does not contact the first lateral surface; whereby spacing between the first and second hub members is minimized to restrict fluid flow to the sealed bearing.

18. The dishwasher of claim 17, wherein the sealed bearing includes a plurality of roller bearings lubricated by a food grade grease and sealed between the inner and outer races by top and bottom seals disposed between the inner and outer races to prevent flow through the bearing.

19. The dishwasher of claim 10, wherein the fluid supply means includes a pump in fluid communication with a manifold through a fluid supply tube, and wherein the manifold includes a threaded fitting for mating with the threaded fitting on the second hub member.

20. A wash arm hub for use in a dishwasher to rotatably connect a wash arm to a fluid supply, the wash arm hub comprising:

(a) first and second hub members defining an internal channel for communicating fluid between the fluid supply and the wash arm; and (b) a sealed bearing coupled between the first and second hub members for sealing the internal channel and permitting relative rotation between the first and second hub members, wherein the sealed bearing is annular, wherein the internal channel extends through a central aperture in the sealed bearing, wherein the first hub member also includes a first annular flange extending through the central aperture of the sealed bearing and defining a portion of the internal channel, wherein the second hub member includes a second annular flange housing the sealed bearing, wherein the sealed bearing includes inner and outer races, wherein the second annular flange on the second hub member has an inner diameter which is slightly smaller than an outer diameter of the outer race of the sealed bearing such that the outer race of the sealed bearing is press fit within the second flange, and wherein the first annular flange on the first hub member has an outer diameter which is slightly larger than an inner diameter of the inner race of the sealed bearing such that the first flange is press fit within the inner race of the sealed bearing.

21. A dishwasher, comprising:

(a) a wash tank;

(b) a fluid supply means for supplying a wash fluid to the wash tank;

(c) a wash arm in fluid communication with the fluid supply means; and (d) a wash arm hub including:

(1) first and second hub members, respectively mounted to the wash arm and the fluid supply means and defining an internal channel for communicating wash fluid between the fluid supply means and the wash arm; and (2) a sealed bearing coupled between the first and second hub members for sealing the channel and permitting relative rotation between the first and second hub members, wherein the sealed bearing is annular, wherein the internal channel extends through a central aperture in the sealed bearing, wherein the first hub member also includes a first annular flange extending through the central aperture of the sealed bearing and defining a portion of the internal channel, wherein the second hub member includes a second annular flange housing the sealed bearing, wherein the sealed bearing includes inner and outer races, wherein the second annular flange on the second hub member has an inner diameter which is slightly smaller than an outer diameter of the outer race of the sealed bearing such that the outer race of the sealed bearing is press fit within the second flange, and wherein the first annular flange on the first hub member has an outer diameter which is slightly larger than an inner diameter of the inner race of the sealed bearing such that the first flange is press fit within the inner race of the sealed bearing.

* * * * *